US006315046B1

(12) United States Patent
Jack et al.

(10) Patent No.: US 6,315,046 B1
(45) Date of Patent: Nov. 13, 2001

(54) METHOD OF SERVICING A WELL

(75) Inventors: Lenard Alfred Jack, Kitscoty; Dean Edward Moan, Blackfoot, both of (CA)

(73) Assignee: Lede Enterprises Ltd., Kitscoty (CA)

( * ) Notice: Subject to any disclaimer, the term of this patent is extended or adjusted under 35 U.S.C. 154(b) by 0 days.

(21) Appl. No.: 09/539,726

(22) Filed: Mar. 30, 2000

(30) Foreign Application Priority Data

Apr. 1, 1999 (CA) ..... 2268233

(51) Int. Cl.[7] ..... E21B 33/03; E21B 33/068

(52) U.S. Cl. ..... 166/312; 166/90.1; 166/368

(58) Field of Search ..... 166/311, 312, 166/368, 269, 305.1, 77.1, 77.2, 90.1

(56) References Cited

U.S. PATENT DOCUMENTS 4,223,724 * 9/1980 Levoni et al. ..... 166/68
4,765,410 * 8/1988 Rogers et al. ..... 166/312 X
4,778,006 * 10/1988 Derowitsch ..... 166/267
4,972,904 * 11/1990 Gordare ..... 166/77
5,865,249 * 2/1999 Gipson et al. ..... 166/312
6,142,232 * 11/2000 Troutt et al. ..... 166/312

OTHER PUBLICATIONS

"Geothermal Wellheads and Gate Valves," from Cameron Ironworks Web Site, pp. 1–3, published at least as early as Apr. 1, 1998.

* cited by examiner

*Primary Examiner*—Frank S. Tsay
(74) *Attorney, Agent, or Firm*—Christensen O'Connor Johnson Kindness PLLC

(57) ABSTRACT

In accordance with a method of servicing a well there is provided a casing spool having an endless tubing access port. The endless tubing access port has a feed passage that extends toward the first end and outwardly from the body. The feed passage terminates in a flow control valve. Endless tubing is extended through the endless tubing access port while a tubing hanger is still in position supporting a tubing string. The endless tubing passes along the central flow passage beside the tubing string. Fluids are then pumped through the endless tubing to promote circulation within the well.

2 Claims, 2 Drawing Sheets

METHOD OF SERVICING A WELL

FIELD OF THE INVENTION

The present invention relates to a method of servicing a well and, in particular, a method of cleaning a well that is contaminated by accumulations of sand.

BACKGROUND OF THE INVENTION

With many producing wells the incursion of sand into the well is a problem. When it becomes apparent that the incursion of sand is adversely affecting the production from the well to such an extent that the well is not economical, the well is serviced to clean out the accumulated sand. Current procedures for cleaning sand from the well involve the use of a service rig to pull the tubing hanger and remove the sucker rods and tubing string. A sandline bailing unit or tubing bailing unit is then used to remove sand from the wellbore. This is a costly and time consuming procedure.

SUMMARY OF THE INVENTION

What is required is an alternative method of servicing a well.

According to the present invention there is provided a method of servicing a well. In accordance with the method a casing spool is provided having a body with an exterior surface, a first end, a second end, and a central flow passage. An attachment flange is provided at the first end of the body. An internal bowl is positioned at the first end of the body providing a seat for a tubing hanger. At least one endless tubing access port is positioned between the internal bowl and the second end of the body. The endless tubing access port extends from the exterior surface to the central flow passage in an angular orientation from the exterior surface toward the second end of the body. The endless tubing access port has a feed passage that extends toward the first end and outwardly from the body. The feed passage terminates in a flow control valve. The casing spool is installed on a well by securing the second end of the body to well casing, and positioning in the internal bowl a tubing hanger supporting a tubing string. When accumulated sand adversely affects the performance of the well, endless tubing is extended through the endless tubing access port while the tubing hanger is still in position supporting the tubing string. The endless tubing passes along the central flow passage beside the tubing string. Fluids are then pumped through the endless tubing to promote fluid circulation.

The method, as described above, eliminates the need for a service rig to attend the well and pull the tubing hanger and tubing string prior to sand clean out procedures. A less costly endless tubing unit can attend the well and either wash a majority of the accumulated sand back into the formation or up to surface.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
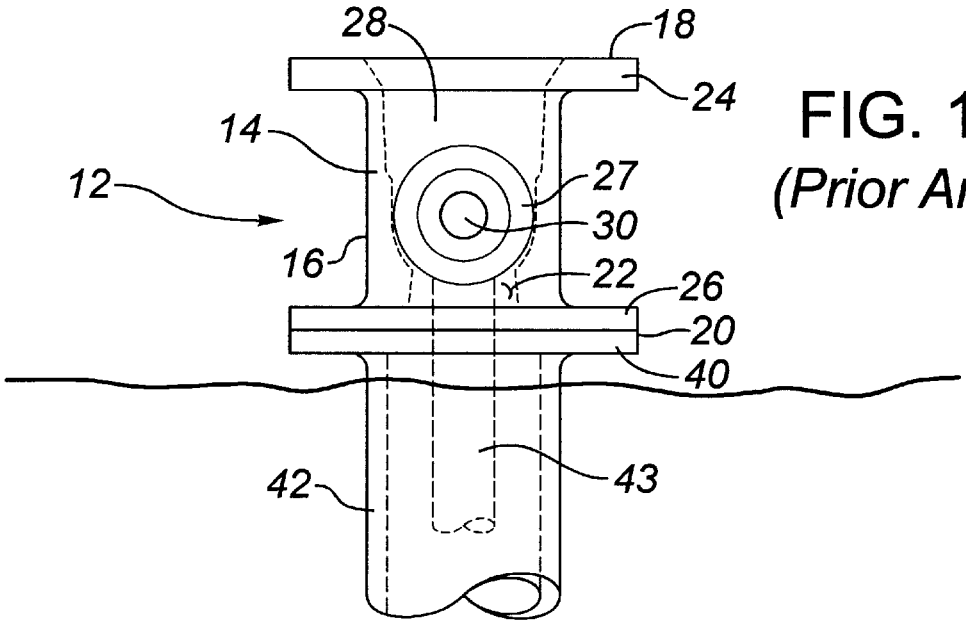
FIG. 1 (Prior Art)
FIG. 1 is a side elevation view, in section, of a PRIOR ART casing spool.

The preferred embodiment, a casing spool generally identified by reference numeral 10, will now be described with reference to FIGS. 1 and 2.

Referring to FIG. 1, which is labelled as PRIOR ART, there is illustrated a prior art casing spool generally identified by reference numeral 12. Casing spool 12 includes a cylindrical body 14 having an exterior surface 16, a first end 18, a second end 20, and a central flow passage 22, an outline of which is shown as dotted lines. A first attachment flange 24 is at first end 18 of body 14. A second attachment flange 26 is at second end 20 of body 14. An internal bowl 28, an outline of which is shown as dotted lines, is at first end 18 of body 14. Casing spool 12 has a valve 30 that extends radially from internal bowl 28. When in use, second attachment flange 26 is rigidly attached to a flange 40 of well casing 42. A tubing string 43 is suspended by means of a tubing hanger 27 from internal bowl 28.

Figure 2:
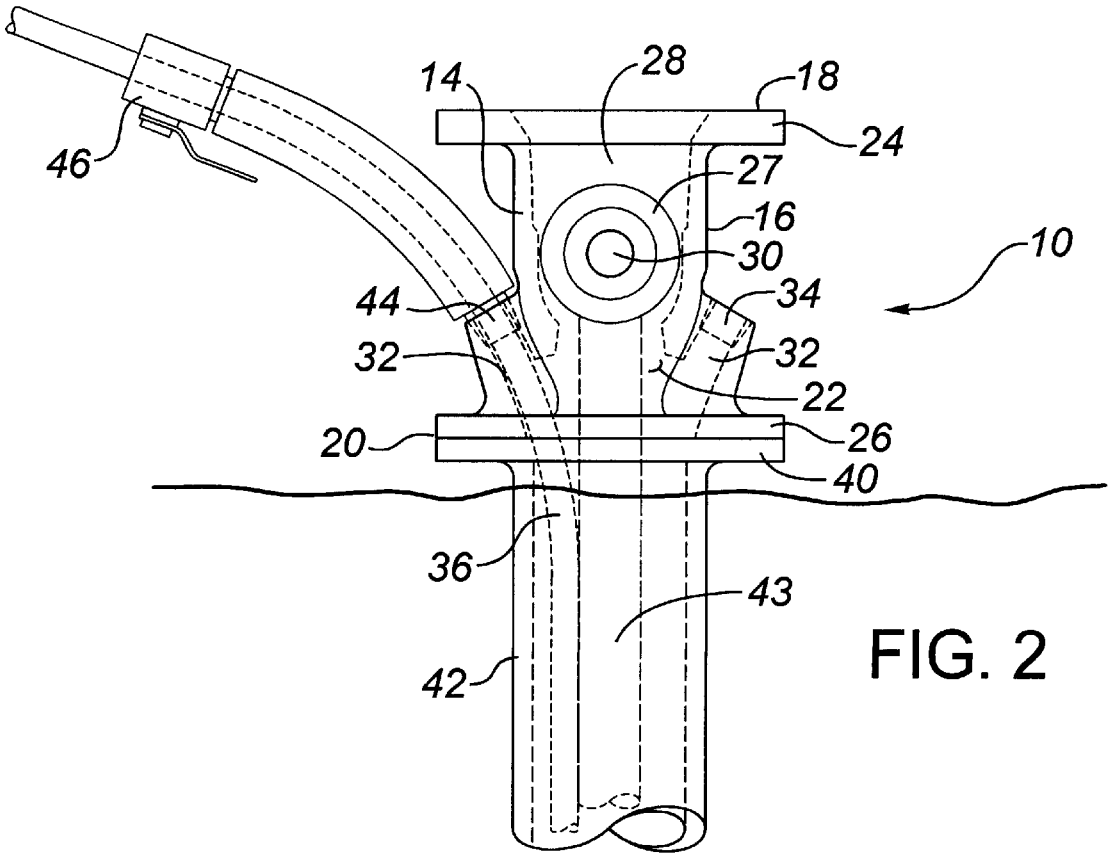
FIG. 2 is a side elevation view, in section, of a casing spool constructed in accordance with the teachings of the present invention.

Referring to FIG. 2, casing spool 10 is illustrated. Those elements that casing spool 10 shares in common with casing spool 12 have been labelled with the identical reference numerals. Casing spool 10 is similar to casing spool 12 in that casing spool 10 has a cylindrical body 14 having an exterior surface 16, a first end 18, a second end 20, and a central flow passage 22. There is a first attachment flange 24 at first end 18 of body 14. There is a second attachment flange 26 at second end 20 of body 14. There is an internal bowl 28 at first end 18 of body 14. A valve 30 extends radially from internal bowl 28. Second attachment flange 26 is rigidly attached to flange 40 of well casing 42. A tubing string 43 is suspended by means of a tubing hanger 27 from internal bowl 28.

Casing spool 10 differs from casing spool 12 in that one or more endless tubing access ports 32 are positioned between internal bowl 28 and second end 20 of body 14. Endless tubing access ports 32 extend from exterior surface 16 to central flow passage 22, in an angular orientation from the exterior surface 16 toward second end 20 of body 14. Although more than one endless tubing access port 32 is provided, it is only contemplated that one will be required at any installation. More than one is provided only to allow access from various sides of the installation. It is expected that in most installations the positioning of other equipment will preclude access from one or more sides. Endless tubing access ports 32 that are not required are sealed by a removable plug 34. Endless tubing access port 32 that is to be used has a feed passage 44 that extends toward first end 18 and outwardly from body 14. Feed passage 44 terminates in flow control valve 46.

Figure 3:
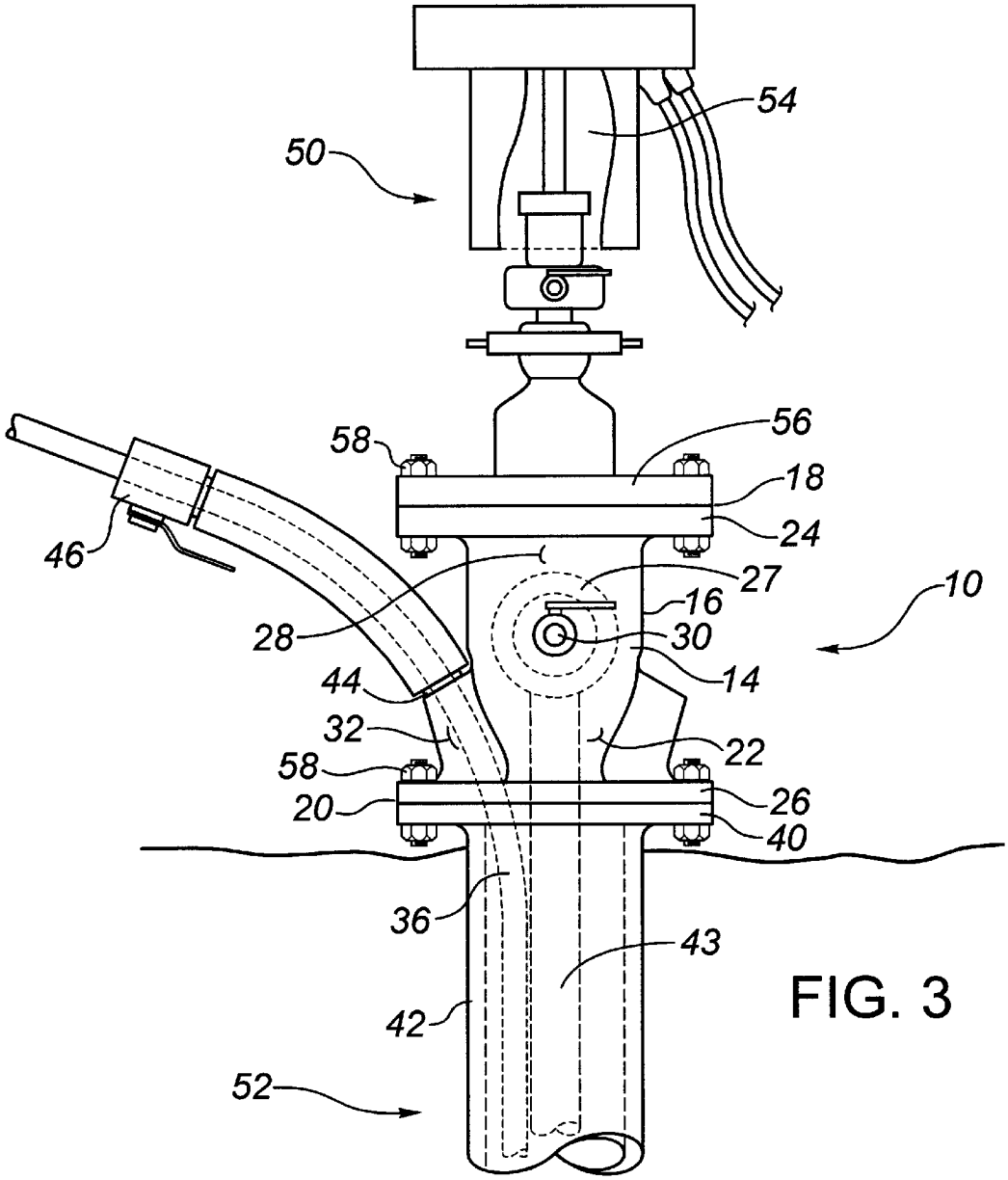
FIG. 3 is a side elevation view, partly in section, of the casing spool illustrated in FIG. 2 installed on a well.

Referring to FIG. 3, a wellhead assembly 50 is used for continuous extraction of fluids from a well 52. Wellhead assembly 50 includes casing spool 10 attached to well casing 42 as described above. A fluids extraction equipment 54 to withdraw fluids up tubing string 43 is permanently mounted on casing spool 10. Fluids extraction equipment 54 has a flange 56 that is rigidly attached by means of bolts 58 to first attachment flange 24 of casing spool 10.

The use and operation of casing spool 10 will now be described with reference to FIG. 2. When it becomes apparent that the incursion of sand is adversely affecting the production from the well to such an extent that the well is not economical, sand must be cleaned from the well. Endless tubing 36 is passed through endless tubing access port 32 into central flow passage 22 alongside of tubing string 43 to a selected depth within the well. Water is then passed through endless tubing 36 to force sand in the well back into the formation from which it originated. Alternatively, water is pumped down tubing string 43, in a direction of flow that is the reverse of the normal pattern of flow within said tubing string 43. The incursion of sand within the well mixes with the water, and then flows up endless tubing 36 to the surface, and the sand is thereby removed from the well.

The method, as described above, eliminates the need for a service rig to attend the well and pull the tubing hanger and tubing string during sand clean out procedures. It is, therefore, a less costly and a less time consuming procedure than the procedure previously required to be used with casing spool 12.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of servicing a well, comprising the steps of:

providing a casing spool having:

a body having an exterior surface, a first end, a second end, and a central flow passage;

an attachment flange at the first end of the body;

an internal bowl at the first end of the body providing a seat for a tubing hanger;

at least one endless tubing access port positioned between the internal bowl and the second end of the body, the endless tubing access port extending from the exterior surface to the central flow passage in an angular orientation from the exterior surface toward the second end of the body, the endless tubing access port having a feed passage that extends toward the first end and outwardly from the body, the feed passage terminating in a flow control valve;

installing the casing spool on a well by securing the second end of the body to well casing, and positioning in the internal bowl a tubing hanger supporting a tubing string;

extending endless tubing through the endless tubing access port while the tubing hanger is still in position supporting the tubing string, such that the endless tubing passes along the central flow passage beside the tubing string; and pumping fluids through the endless tubing.

2. A casing spool, comprising:

a body having an exterior surface, a first end, a second end, and a central flow passage;

an attachment flange at the first end of the body;

an internal bowl at the first end of the body providing a seat for a tubing hanger;

two or more endless tubing access ports positioned between the internal bowl and the second end of the body, each of the two or more endless tubing access ports extending from the exterior surface to the central flow passage in an angular orientation from the exterior surface toward the second end of the body, each of the two or more endless tubing access ports having a feed passage that extends toward the first end and outwardly from the body, each of the feed passages terminating in one of a flow control valve and a plug.

* * * * *

UNITED STATES PATENT AND TRADEMARK OFFICE

CERTIFICATE OF CORRECTION

PATENT NO. : 6,315,046 B1
DATED : November 13, 2001
INVENTOR(S) : L.A. Jack et al.

It is certified that error appears in the above-identified patent and that said Letters Patent is hereby corrected as shown below:

Title page,
Item [30], Foreign Application Priority Data, "2268233" should read -- 2268223 --

Signed and Sealed this

Seventh Day of May, 2002

*Attest:*

*Attesting Officer*

JAMES E. ROGAN
*Director of the United States Patent and Trademark Office*